US009004040B2

(12) United States Patent
Russo et al.

(10) Patent No.: US 9,004,040 B2
(45) Date of Patent: Apr. 14, 2015

(54) TIMING COVER ASSEMBLY FOR AN INTERNAL COMBUSTION ENGINE

(75) Inventors: Francesco Russo, Turin (IT); Domenico Palmisani, Turin (IT); Lorenzo Magro, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 591 days.

(21) Appl. No.: 13/302,023

(22) Filed: Nov. 22, 2011

(65) Prior Publication Data

US 2012/0125283 A1 May 24, 2012

(30) Foreign Application Priority Data

Nov. 23, 2010 (GB) ..... 1019804.2

(51) Int. Cl.
*F02F 7/00* (2006.01)

(52) U.S. Cl.
CPC ..... *F02F 7/0073* (2013.01)

(58) Field of Classification Search
USPC ..... 123/90.37, 90.38, 195 C, 198 E
See application file for complete search history.

(56) References Cited

U.S. PATENT DOCUMENTS

| | | | | |
|---|---|---|---|---|
| 4,832,349 | A | 5/1989 | Kawai et al. | |
| 4,867,335 | A | 9/1989 | Segal | |
| 4,944,264 | A * | 7/1990 | Murasaki et al. | 123/195 C |
| 4,977,870 | A | 12/1990 | Hashimoto et al. | |
| 5,000,142 | A * | 3/1991 | Aruga et al. | 123/195 C |
| 5,010,855 | A * | 4/1991 | Ogami et al. | 123/195 C |
| 5,148,784 | A * | 9/1992 | Hiraoka et al. | 123/195 C |
| 5,222,745 | A | 6/1993 | Akbar et al. | |
| 5,503,117 | A * | 4/1996 | Saito | 123/195 C |
| 2003/0051695 | A1 | 3/2003 | Coleman | |
| 2008/0066710 | A1 | 3/2008 | Stemmer | |

FOREIGN PATENT DOCUMENTS

| | | | |
|---|---|---|---|
| DE | 19845320 | A1 | 4/2000 |
| DE | 10025658 | A1 | 11/2001 |
| EP | 1522769 | A1 | 4/2005 |
| EP | 1640589 | A1 | 3/2006 |
| GB | 2231087 | A | 11/1990 |

OTHER PUBLICATIONS

British Patent Office, British Search Report for Application No. 1019804.2, dated Mar. 18, 2011.

* cited by examiner

*Primary Examiner* — Noah Kamen
(74) *Attorney, Agent, or Firm* — Ingrassia Fisher & Lorenz, P.C.

(57) ABSTRACT

An internal combustion engine includes, but is not limited to an engine block, a crankshaft associated to the engine block, a cylinder head fixed on top of the engine block so as to define an assembly axis of the internal combustion engine, a camshaft, and a housing for a timing device connecting the crankshaft to the camshaft, the housing having a frontal opening which is laterally delimited by two opposite sidewalls belonging to the engine block and two opposite sidewalls belonging to the cylinder head, the frontal opening being closed with a first cover fixed to the sidewalls of the engine block, and with a second cover fixed to the sidewalls of the cylinder head.

5 Claims, 7 Drawing Sheets

TIMING COVER ASSEMBLY FOR AN INTERNAL COMBUSTION ENGINE

CROSS-REFERENCE TO RELATED APPLICATION

This application claims priority to British Patent Application No. 1019804.2, filed Nov. 23, 2010, which is incorporated herein by reference in its entirety.

TECHNICAL FIELD

The technical field relates to an internal combustion engine of a motor vehicle, in particular, to structural features of an internal combustion engine.

BACKGROUND

It is known that a conventional internal combustion engine comprises an engine block that is configured for accommodating a rotating crankshaft, whose axis of rotation defines the longitudinal axis of the internal combustion engine. With respect to a transversal axis perpendicular to this longitudinal axis, the internal combustion engine further comprises a cylinder head fixed on top of the engine block, and a head cover fixed on top of the cylinder head. The cylinder head generally accommodates a rotating camshaft that is provided for operating the puppet valves of the internal combustion engine.

This camshaft is conventionally driven by the crankshaft, by means of a dedicated timing device, such as for example a timing belt, a timing chain, or a timing gearing. The timing device is accommodated into a housing of the internal combustion engine, which is provided with a frontal opening that guarantees the fully accessibility of the timing device.

The frontal opening is perpendicularly oriented with respect to the longitudinal axis of the internal combustion engine, and is laterally delimited, in a lower part, by two opposite sidewalls belonging to the engine block and, in an upper part, by two opposite sidewalls belonging to the cylinder head. With respect to the axis of rotation of the crankshaft, the timing device and its housing are conventionally located in a front side of the internal combustion engine, opposite a rear side of the internal combustion engine, which is conventionally associated to a transmission assembly.

In this conventional layout, the frontal opening of the timing device housing can be closed by means of a single cover, which is fixed to both the above-mentioned sidewalls of the engine block and sidewalls of the cylinder head. However, new layouts may be required to locate the timing device and its housing in the rear side of the internal combustion engine, between the internal combustion engine and the transmission. In this case, the solution of closing the timing device housing with a single cover is not advisable, because any service of the timing device would necessarily require the dismantling of the transmission assembly.

At least one object is to provide a practical solution for closing the timing housing. At least another object is to provide a solution that can be employed also if the timing housing is located in the rear side of the internal combustion engine, allowing serviceability of the timing device without requesting transmission disassembly. At least another object is to achieve the above-mentioned goals with a simple, rational, and rather inexpensive solution. In addition, other objects, desirable features, and characteristics will become apparent from the subsequent summary and detailed description, and the appended claims, taken in conjunction with the accompanying drawings and this background.

SUMMARY

An internal combustion engine is provided that comprises an engine block, a crankshaft associated to the engine block, a cylinder head fixed on top of the engine block so as to define an assembly axis of the internal combustion engine, a camshaft, and a housing for a timing device connecting the crankshaft to the camshaft. This housing has a frontal opening that is laterally delimited by two opposite sidewalls belonging to the engine block and two opposite sidewalls belonging to the cylinder head. The frontal opening is closed by means of a first cover fixed to the sidewalls of the engine block, and by means of a second cover fixed to the sidewalls of the cylinder head. This solution advantageously allows to disassembly the second cover independently from the first cover, thereby making the timing device accessible, even if the frontal opening of the housing is not completely open.

According to an embodiment, the first cover comprises an engaging portion having an internal side facing inside the housing, an external side facing outside the housing and two opposite lateral sides, each of which overlaps respective sidewalls of the engine block. The second cover comprises in turn an engaging portion having a cavity that matches the engaging portion of the first cover, so that the engaging portion of the second cover covers the external side and the lateral sides of the engaging portion of the first cover. This solution allows an effective hermetical closure of the housing of the timing device, which prevent lubricant leakages.

According to another embodiment, the cavity of the engaging portion of the second cover realizes a prismatic joint with the engaging portion of the first cover, which leaves to the first cover and to the second cover a mutual degree of freedom along a direction parallel to said assembly axis of the internal combustion engine. This feature provides a hermetical closure of the housing of the timing device, even if the first cover and the second cover are fixed at slightly different mutual distances in the direction of said assembly axis of the internal combustion engine.

In fact, the cylinder head is generally assembled to the engine block with the interposition of a gasket. For an accurate compression ratio of the cylinders, it is known to use gaskets having slightly different heights, so that the distance between the cylinder head and the engine block, in the direction of the assembly axis of the internal combustion engine, can slightly vary from one internal combustion engine to another of the same kind. These variations affect also the distance between the first cover and the second cover, which are respectively fixed to the engine block and to the cylinder head. The prismatic joint between the first cover and the second cover allows compensating these small variations, thereby always guaranteeing the hermetical closure of the housing of the timing device.

According to another embodiment, the opposite lateral sides of the engaging portion of the first cover are mutually inclined, and the cavity of the engaging portion of the second cover comprises inclined surfaces adapted to match this inclined lateral sides. This feature advantageously provides the hermetical closure of the housing of the timing device, even if the first cover and the second cover are fixed at slightly different mutual distances in the direction of the longitudinal axis of the internal combustion engine, as well as in a direction perpendicular to both the longitudinal axis and said assembly axis of the internal combustion engine. In fact, it has been found that the above-mentioned gasket can cause the cylinder head to be misaligned with respect to the engine block, both in the direction of the longitudinal axis of the internal combustion engine and in a direction perpendicular to the longitudinal axis and to the assembly axis of the internal combustion engine. As in the preceding case, this misalignment affects also the mutual position of the first cover and of the second cover, which are respectively fixed to the engine block and to the cylinder head. The inclination of the lateral sides of the engaging portion of the first cover and of the correspondent surfaces of the cavity of the second cover allows compensating this misalignment, thereby guaranteeing the hermetical closure of the housing of the timing device.

According to another embodiment, the hermetical closure of the housing is guaranteed with the aid of a seal that is interposed between the engaging portion of the first cover and the engaging portion of the second cover.

According to an embodiment, the first cover is further fixed to a transmission assembly, and the second cover is configured to be dismountable independently with respect to this transmission assembly. In fact, this embodiment can be implemented when the housing of the timing device is located in the rear side of the internal combustion engine, between the internal combustion engine and the transmission assembly. Therefore, the second cover can be easily removed to service the timing device, without requesting transmission disassembly.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

The internal combustion engine 10 comprises an engine block 11 that is generally realized by means of a bedplate and a cylinder block fixed on top of the bedplate. The engine block 11 is provided for accommodating a rotating crankshaft 12, whose axis of rotation defines the longitudinal axis X of the internal combustion engine 10. The internal combustion engine 10 has a front side A and a rear side B, which are mutually opposed with respect to the longitudinal axis X.

Figure 10:
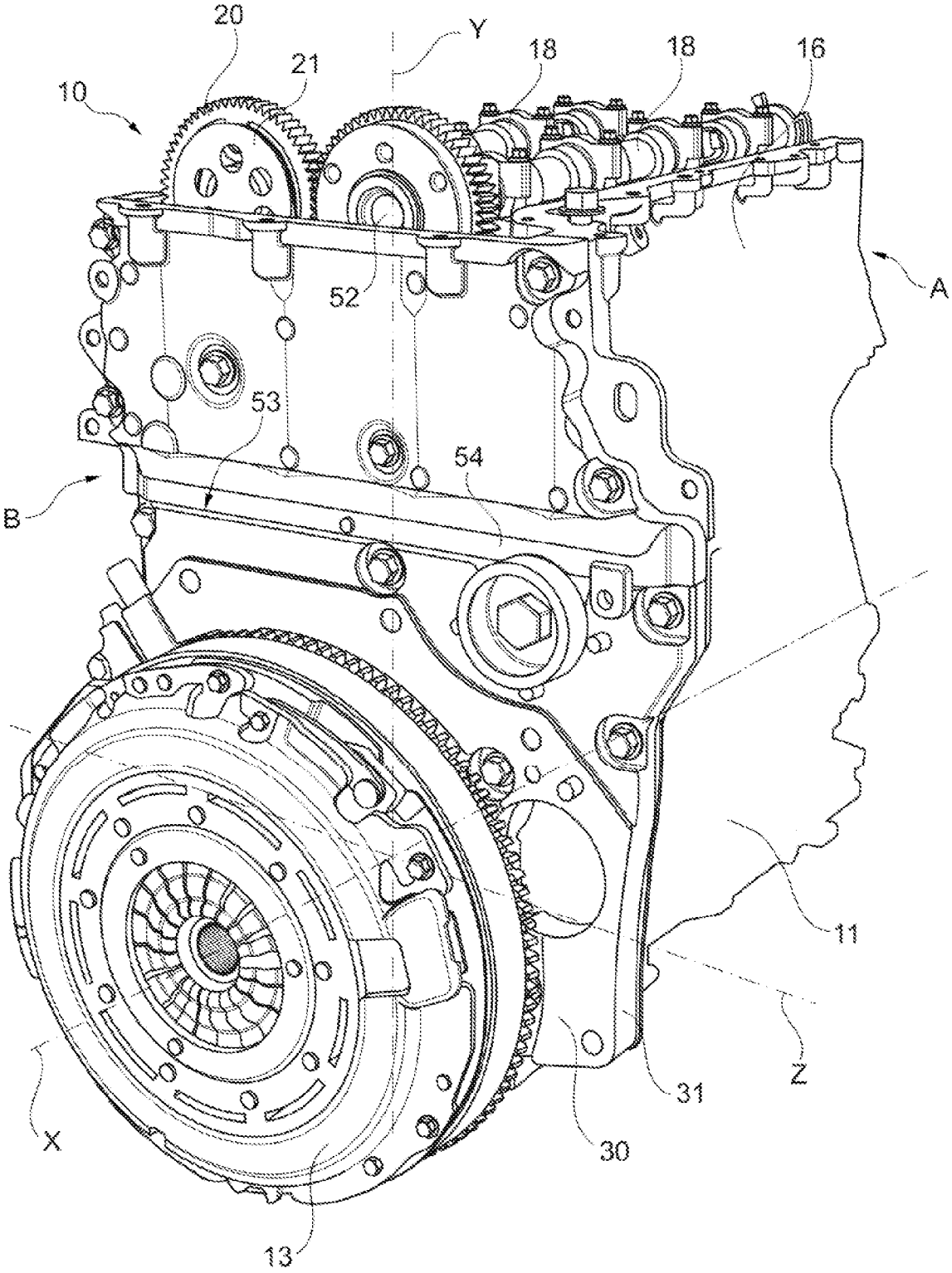
FIG. 10 is a prospective view showing the engine block, the cylinder head, the first cover, and the second cover, which close the housing for the timing device, of the Diesel engine of FIG. 1, and a transmission assembly associated to the Diesel engine.

As shown in FIG. 10, at the rear side B of the internal combustion engine 10, the crankshaft 12 is connected to a conventional transmission assembly 13 of the motor vehicle. The internal combustion engine 10 has an assembly axis Y, which is perpendicular to the longitudinal axis X, and a transversal axis Z, which is perpendicular to both the longitudinal axis X and the assembly axis Y. With respect to the assembly axis Y, the internal combustion engine 10 comprises a lower cover 15 fixed at the bottom of the engine block 11, a cylinder head 16 fixed on top of the engine block 11, and an head cover 17 fixed on top of the cylinder head 16.

In order to provide the hermetical closure of the internal chambers of the internal combustion engine 10, a proper gasket (not shown) is generally interposed between the engine block 11 and the cylinder head 16, as well as between the engine block 11 and the lower cover 15, between the cylinder head 16 and the head cover 17, and between the bedplate and the cylinder block that realize the engine block 11.

Figure 2:
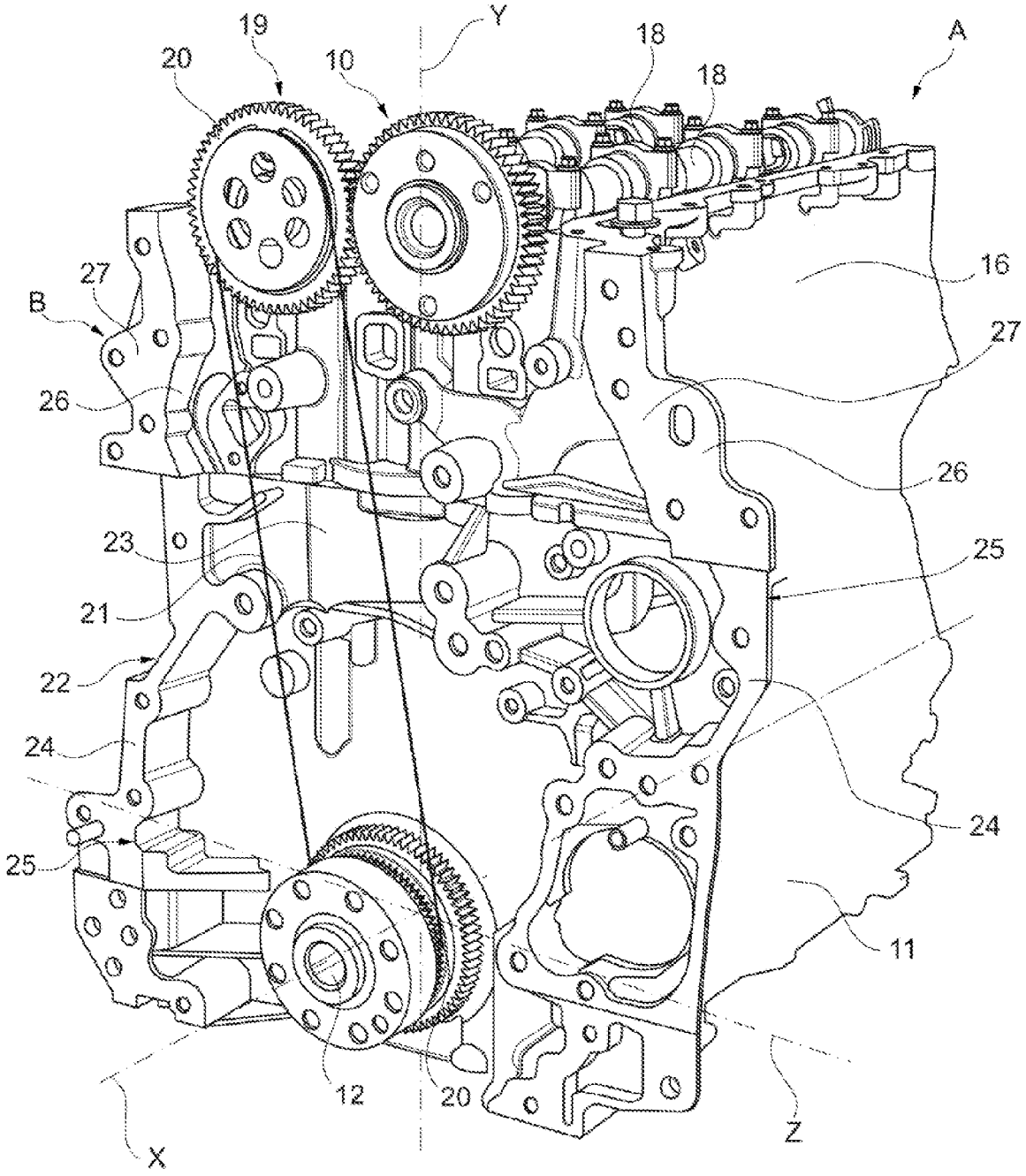
FIG. 2 is a prospective view showing the engine block and the cylinder head of the Diesel engine of FIG. 1.
Figure 3:
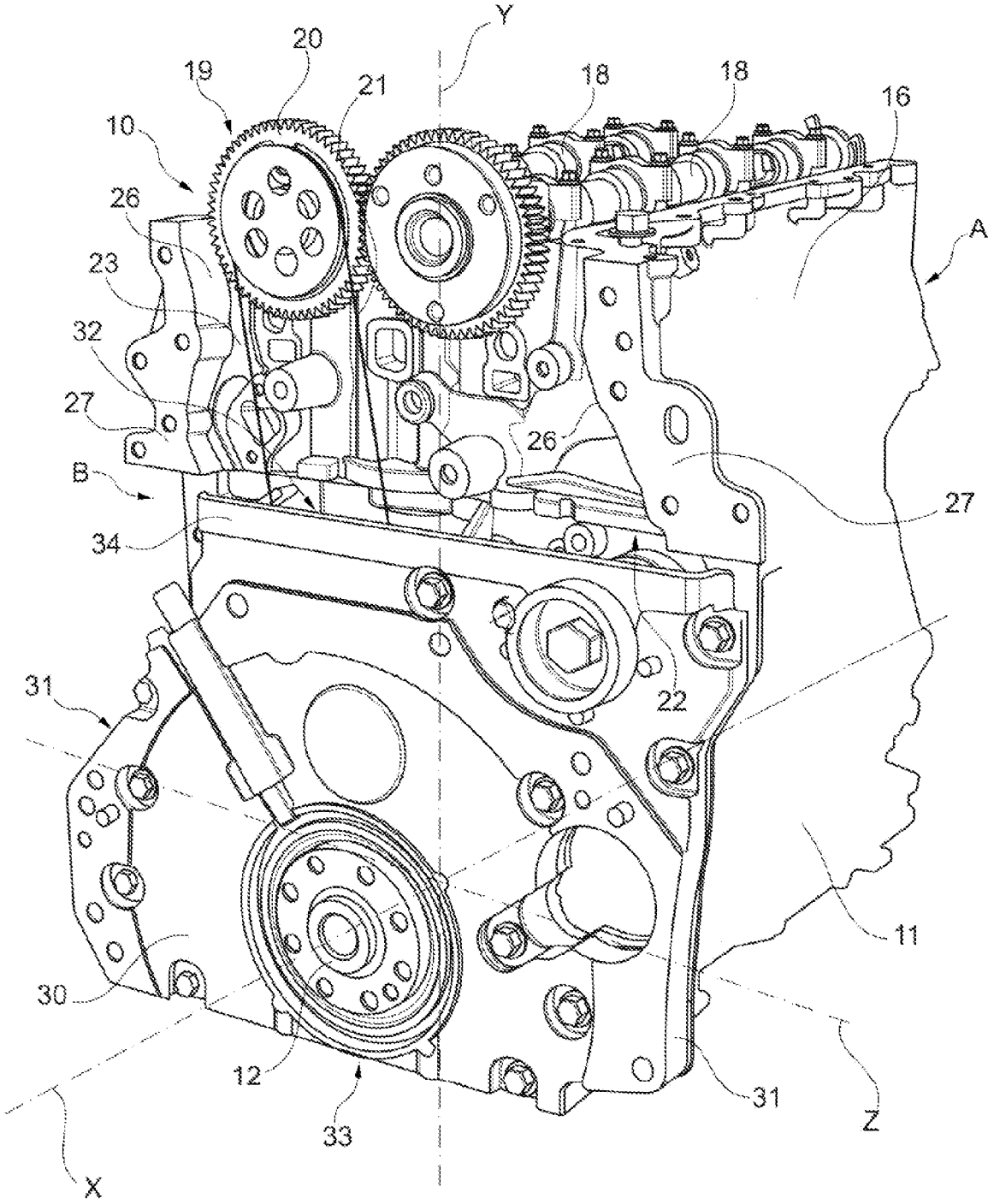
FIG. 3 is a prospective view showing the engine block, the cylinder head and a first cover that partially closes the housing for the timing device, of the Diesel engine of FIG. 1.
Figure 4:
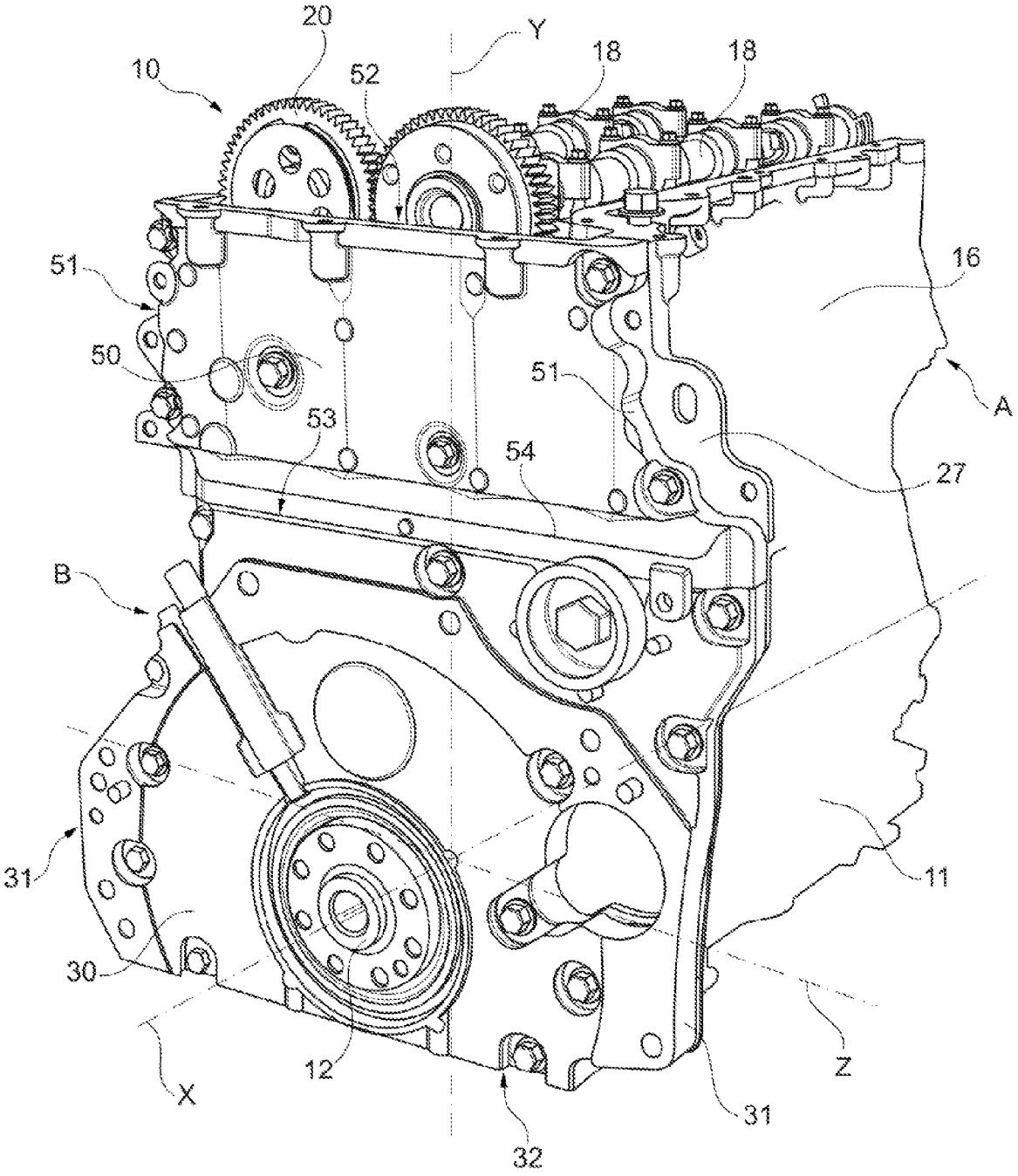
FIG. 4 is a prospective view showing the engine block, the cylinder head, the first cover and the second cover which close the housing for the timing device, of the Diesel engine of FIG. 1.

As shown in FIG. 2, the cylinder head 16 accommodates two rotating camshafts 18 provided for operating the puppet valves (not shown) of the internal combustion engine 10. Each camshaft 18 has an axis of rotation parallel to the longitudinal axis X. Each camshaft 18 is driven by the crankshaft 12, by means of a dedicated timing device, schematically shown in FIG. 2 and globally indicated as 19, which comprises a set of sprocket wheels 20 and a timing chain 21 winding up this sprocket wheels 20.

The sprocket wheels 20 and the timing chain 21 lie in a plane perpendicular to the longitudinal axis X. The timing device 19 is located at the rear side B of the internal combustion engine 10, substantially interposed between the internal combustion engine 10 and the transmission assembly 13. In greater details, the timing device 19 is accommodated into a housing 22 that is realized in the body of the internal combustion engine 10.

The housing 22 is provided with a frontal opening 23 which substantially lies in a plane perpendicular to the longitudinal axis X, and which is provided for guaranteeing the fully accessibility of the timing device 19. A lower part of the frontal opening 23 is laterally delimited by two sidewalls 24 belonging to the engine block 11, which is mutually opposed with respect to the transversal axis Z of the internal combustion engine 10. Each sidewall 24 has a planar flange 25 that lies in a plane perpendicular to the longitudinal axis X, coplanar with the planar flange 25 of the opposite sidewall 24. An upper part of the frontal opening 23 is laterally delimited by two sidewalls 26 belonging to the cylinder head 16, which are mutually opposed with respect to the transversal axis Z of the internal combustion engine 10.

Each sidewall 26 has a planar flange 27 that lies in a plane perpendicular to the longitudinal axis X, coplanar with the planar flange 27 of the opposite sidewall 26. Unless the normal tolerances, each sidewall 26 or the cylinder head 16 is located adjacent and in continuation of a respective sidewall 24 of the engine block 11, with the planar flange 27 coplanar to the planar flange 25.

Figure 1:
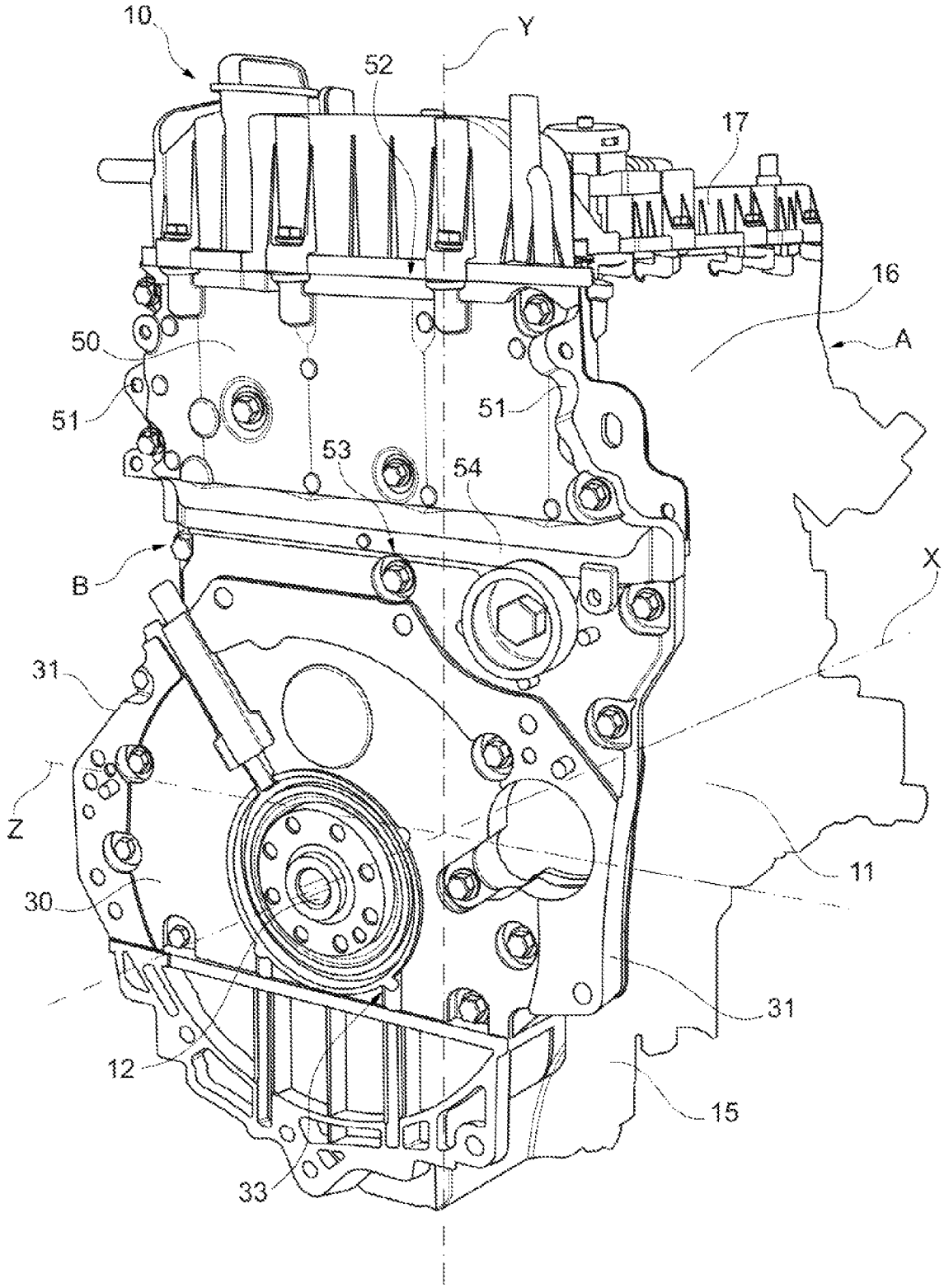
FIG. 1 is a prospective view of an internal combustion engine of a motor vehicle, in this case a Diesel engine.

As shown in FIG. 1 and FIG. 10, the frontal opening 23 of the housing 22 is closed by means of two covers, including a first cover 30 that is bolted to the sidewalls 24 of the engine block 11, and a second cover 50 that is bolted to the sidewalls 26 of the cylinder head 16. In this way, the second cover 50 can be disassembled independently from the first cover 30, thereby making the timing device 19 accessible, even if the frontal opening 23 of the housing 22 is not completely open. Both the first cover 30 and the second cover 50 are substantially planar and lie in plane perpendicular to the longitudinal axis X. The first cover 30 has two lateral edges 31, which are mutually opposed with respect to the transversal axis Z of the internal combustion engine 10.

Each lateral edge 31 overlaps a respective sidewall 24 of the engine block 11, so that the first cover 30 rests on the planar flanges 25. Furthermore, the first cover 30 has an upper edge 32 and a lower edge 33, which are mutually opposed with respect to the assembly axis Y of the internal combustion engine 10. The lower edge 33 of the first cover 30 matches a correspondent flange of the lower cover 15. Analogously, the second cover 50 has two lateral edges 51, which are mutually opposed with respect to the transversal axis Z of the internal combustion engine 10.

Figure 5:
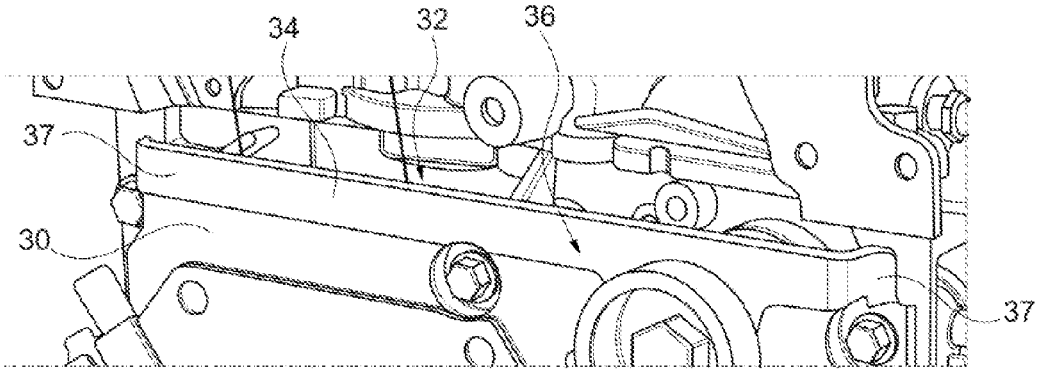
FIG. 5 is a magnified detail of FIG. 3.
Figure 6:
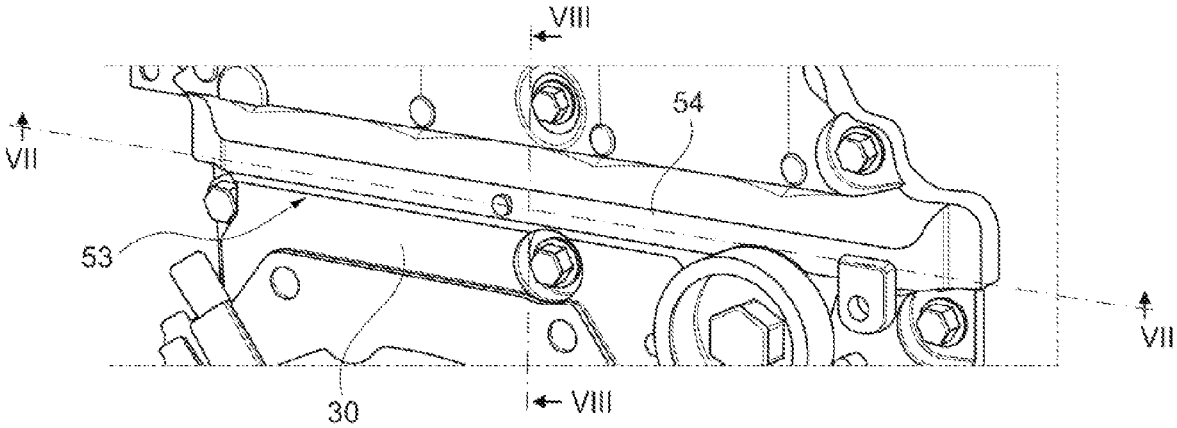
FIG. 6 is a magnified detail of FIG. 4.

Each lateral edge 51 overlaps a respective sidewall 26 of the cylinder head 16, so that the second cover 50 rests on the planar flanges 27. The second cover has also an upper edge 52 and a lower edge 53, which are mutually opposed with respect to the assembly axis Y of the internal combustion engine 10. The upper edge 52 of the second cover 50 matches a correspondent flange of the head cover 17. The lower edge 53 of the second cover 50 is defined by an engaging portion 54 that overlaps a correspondent engaging portion 34 of the first cover 30 (see. FIGS. 5 and 6), which defines the upper edge 32 of the first cover 30.

Figure 7:
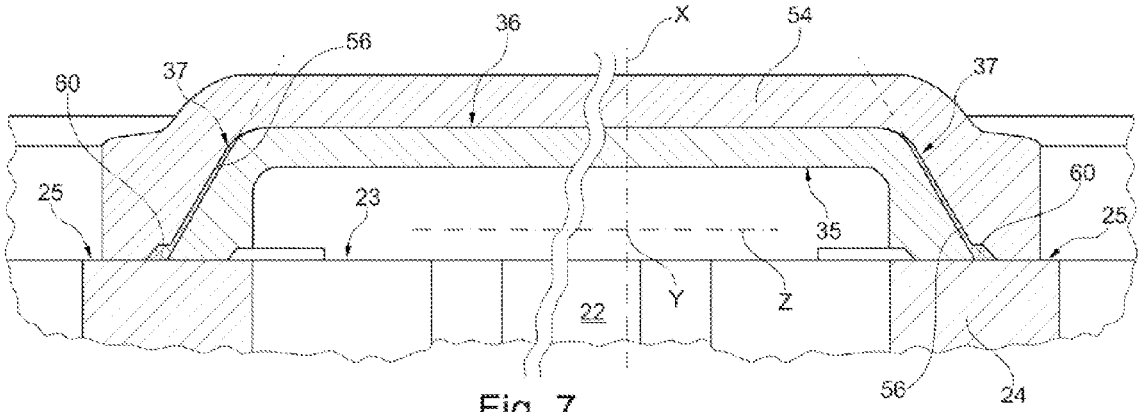
FIG. 7 is the section VII-VII indicated in FIG. 6.

As shown in FIG. 7, the engaging portion 34 of the first cover 30 has an internal side 35 facing inside the housing 22, an external side 36 facing outside the housing 22, and two opposite lateral sides 37, each of which overlaps a respective sidewall 24 of the engine block 11. The engaging portion 54 of the second cover 50 comprises a cavity 55 facing inside the housing 22, whose section, in any plane perpendicular to the assembly axis Y, has substantially the same shape of the section of the engaging portion 34 of the first cover 30. In this way, the cavity 55 of the second cover 50 matches the engaging portion 34 of the first cover 30, so as to cover the external side 36 and the opposite lateral sides 37 of the engaging portion 34, thereby guaranteeing the hermetical closure of the frontal opening 23.

Figure 9:
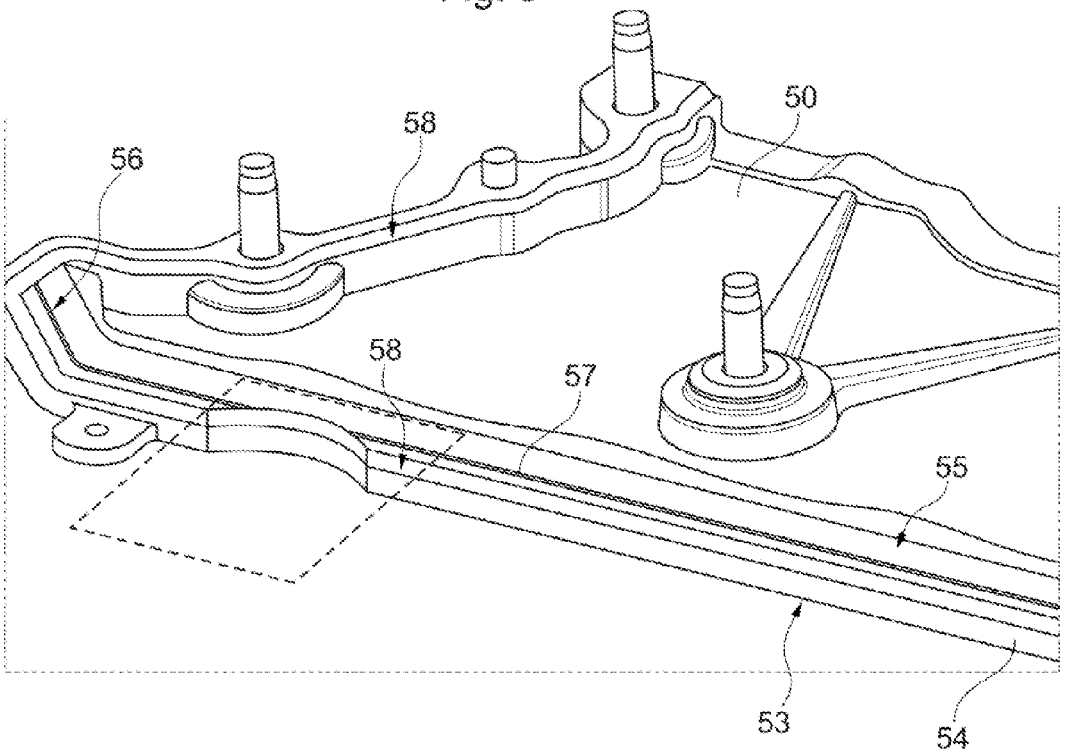
FIG. 9 is a prospective view of the internal side of the second cover.

The hermetical closure of the frontal opening 23 is further improved with the aid of a seal 60, which is interposed between the internal surfaces of the cavity 55 of the second cover 50 and the engaging portion 34 of the first cover 30. As shown in FIG. 9, the seal 60 is accommodated in a groove 57 of the internal surface of the cavity 55 of the second cover 50, which extends transversally for the entire length of the engaging portion 54. In order to improve the hermetical closure of the housing 22, the second cover 50 further comprises a chamfer 58 extending along the perimetrical edges of the internal side of the second cover 50, in order to accommodate another seal (not shown).

Figure 8:
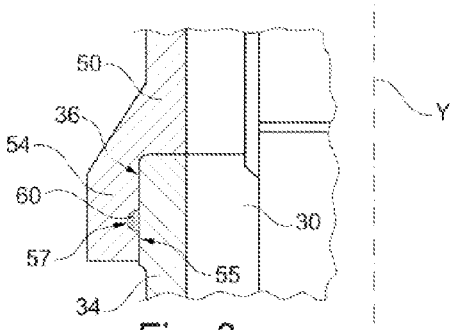
FIG. 8 is the section VIII-VIII indicated in FIG. 6.

According to another embodiment, the section of the cavity 55 and the section of the engaging portion 34 are substantially constant in any plane perpendicular to the assembly axis Y. In this way, the cavity 55 of the second cover 50 and the engaging portion 34 of the first cover 30 realize a prismatic joint, which leaves to the first cover 30 and to the second cover 50 a mutual degree of freedom along a direction parallel to the assembly axis Y (see FIG. 8). This prismatic joint provides the hermetical closure of the frontal opening 23, even if the first cover 30 and the second cover 50 are fixed at slightly different mutual distances in the direction of the assembly axis Y, due for example to assembly issue of the engine block 11, the cylinder head 16 and/or the gasket interposed between them.

According to another embodiment, the opposite lateral sides 37 of the engaging portion 34 of the first cover 30 are inclined (see FIG. 7) with respect to each other, and with respect to the longitudinal axis X and the transversal axis Z of the internal combustion engine 10, so as to converging toward an ideal point located outside the housing 22. In particular, each lateral side 37 is inclined to form an angle of about 30° with respect to the longitudinal axis X. Coherently, the cavity 55 of the second cover 50 is in turn provided with correspondent inclined surfaces 56 adapted to match this inclined lateral sides 37. This feature provides the closure of the frontal opening 23, even if the first cover 30 and the second cover 50 are fixed at slightly different mutual distances in the direction of the longitudinal axis X and/or of the transversal axis Z, due for example to assembly issue of the engine block 11, the cylinder head 16 and/or the gasket interposed between them.

According to still another embodiment, the transmission assembly 13 is fixed only to the first cover 30. In this way, the second cover 50 can be easily removed to service the timing device 19, without dismounting the transmission assembly 13.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the forgoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and in their legal equivalents.

What is claimed is:

1. An internal combustion engine comprising:

an engine block;

a crankshaft associated with the engine block;

a cylinder head fixed on top of the engine block to define an assembly axis of the internal combustion engine;

a camshaft;

a timing device;

a housing for the timing device connecting the crankshaft to the camshaft; and a frontal opening of the housing that is laterally delimited by two opposite sidewalls belonging to the engine block and the two opposite sidewalls belonging to the cylinder head, wherein the frontal opening is closed with a first cover fixed to the two opposite sidewalls of the engine block, the first cover includes an engaging portion having an internal side facing inside the housing and an external side facing outside the housing and two opposite lateral sides that each overlaps a respective sidewall of the engine block, and with a second cover fixed to the two opposite sidewalls of the cylinder head, and the second cover includes the engaging portion having a cavity that matches the engaging portion of the first cover so that the engaging portion of the second cover is configured to cover the external side and both lateral sides of the engaging portion of the first cover.

2. The internal combustion engine according to claim 1, wherein the cavity of the engaging portion of the second cover realizes a prismatic joint with the engaging portion of the first cover, the prismatic joint leaving to the first cover and to the second cover a mutual degree of freedom along a direction parallel to the assembly axis of the internal combustion engine.

3. The internal combustion engine according to claim 1, wherein opposite lateral sides of the engaging portion of the first cover are mutually inclined, and wherein the cavity of the engaging portion of the second cover comprises inclined surfaces configured to match this inclined lateral sides.

4. The internal combustion engine according to claim 1, wherein a seal is interposed between the engaging portion of the first cover and the engaging portion of the second cover.

5. The internal combustion engine according to claim 1, wherein the first cover is further fixed to a transmission assembly, and the second cover is configured to dismount independently with respect to the transmission assembly.

* * * * *